US005511791A

United States Patent [19]

Ebisuno et al.

[11] Patent Number: 5,511,791

[45] Date of Patent: Apr. 30, 1996

[54] THREAD WOUND GOLF BALL

[75] Inventors: Tadahiro Ebisuno, Nishinomiya; Keiji Moriyama; Kazushige Sugimoto, both of Akashi; Tsutomu Hirau, Nishinomiya, all of Japan

[73] Assignee: Sumitomo Rubber Industries, Ltd., Hyogo, Japan

[21] Appl. No.: 288,002

[22] Filed: Aug. 10, 1994

[30] Foreign Application Priority Data

Aug. 13, 1993 [JP] Japan ..... 5-222166

[51] Int. Cl.[6] ..... A63B 37/08

[52] U.S. Cl. ..... 473/354

[58] Field of Search ..... 273/231, 227, 273/226, 222, 62

[56] References Cited

U.S. PATENT DOCUMENTS 5,338,038 8/1994 Cadorniga ..... 273/231 X

FOREIGN PATENT DOCUMENTS 816243 8/1937 France .
453185 9/1936 United Kingdom .
453091 9/1936 United Kingdom ..... 273/231
523626 7/1940 United Kingdom .

*Primary Examiner*—George J. Marlo
*Attorney, Agent, or Firm*—Birch, Stewart, Kolasch & Birch

[57] ABSTRACT

Disclosed is a thread wound golf ball having uniform flying performances, which causes little scattering of weight and inclusion of air into the liquid center, wherein no separation of the paste is arisen. The thread wound golf ball comprises a liquid center, a thread rubber layer and a cover. The liquid center is composed of a paste and a center bag for coating the paste. A viscosity at 23° C. (measured by a B type viscometer) of the paste is 15 to 70 poise.

8 Claims, 1 Drawing Sheet

THREAD WOUND GOLF BALL

FIELD OF THE INVENTION

The present invention relates to a thread wound golf ball. More particularly, it relates to a thread wound golf ball using a paste type liquid center.

BACKGROUND OF THE INVENTION

Thread wound golf balls are classified roughly into two types, e.g. a golf ball using a solid center (center made of a rubber composition) and a golf ball using a liquid center.

Regarding the former thread wound golf ball using a solid center, amount of spin is too large so that the flying distance becomes short, thereby imparting hard feeling (hit feeling). Therefore, professional golfers and advanced players do not like the golf ball with a solid center.

The latter liquid center is classified roughly into two types, e.g. a liquid center containing paste in which a filler is formulated to adjust a specific gravity and that containing liquid which is similar to water. When using the liquid which is similar to water, a rubber center bag for covering (containing) liquid must have a certain degree of a specific gravity so that the hardness of the center bag becomes high, thereby imparting hard feeling in comparison with the center containing paste. Further, the amount of spin becomes too large so that the flying distance becomes short.

To the contrary, regarding the liquid center containing paste in which a filler is formulated to adjust a specific gravity, the paste itself has a certain degree of a specific gravity so that the specific gravity of the center bag can be decreased and the hardness can also be decreased, thereby softening the center entirely.

Accordingly, hit feeling becomes soft and amount of spin does not become too large, which results in good flying performances. Therefore, professional golfers and advanced players like the golf ball with a paste type liquid center.

However, regarding the liquid center containing paste, scattering of quality (e.g scattering of weight, inclusion of air, deviation of center of gravity in the liquid center due to separation of paste into water and filler, etc.) is liable to be arisen, thereby influencing on the flying performances. Therefore, the flying performances are liable to be scattered.

SUMMARY OF THE INVENTION

In order to solve the above problems, the present inventors have intensively studied. As a result, it has been found that, by using a paste having a viscosity of 15 to 70 poise at 23° C. (measured by a B type viscometer), a liquid center which causes little scattering of weight and inclusion of air into the liquid center, wherein no separation of the paste is arisen, can be prepared. Thus, the present invention has been completed.

The present invention provides a thread wound golf ball comprising a liquid center, a thread rubber layer and a cover, wherein said liquid center is composed of a paste and a center bag for coating the paste and a viscosity at 23° C. (measured by a B type viscometer) of said paste is 15 to 70 poise.

The main object of the present invention is to provide a thread wound golf ball having uniform flying performances, wherein the above problems (e.g. scattering of weight and quality of the liquid center, separation of paste, etc.) are solved.

This object as well as other objects and advantages of the present invention will become apparent to those skilled in the art from the following description with reference to the accompanying drawings.

BRIEF EXPLANATION OF THE INVENTION

FIG. 1 is a schematic cross section illustrating one embodiment of the thread wound golf ball of the present invention.

DETAILED DESCRIPTION OF THE INVENTION

Figure 1:
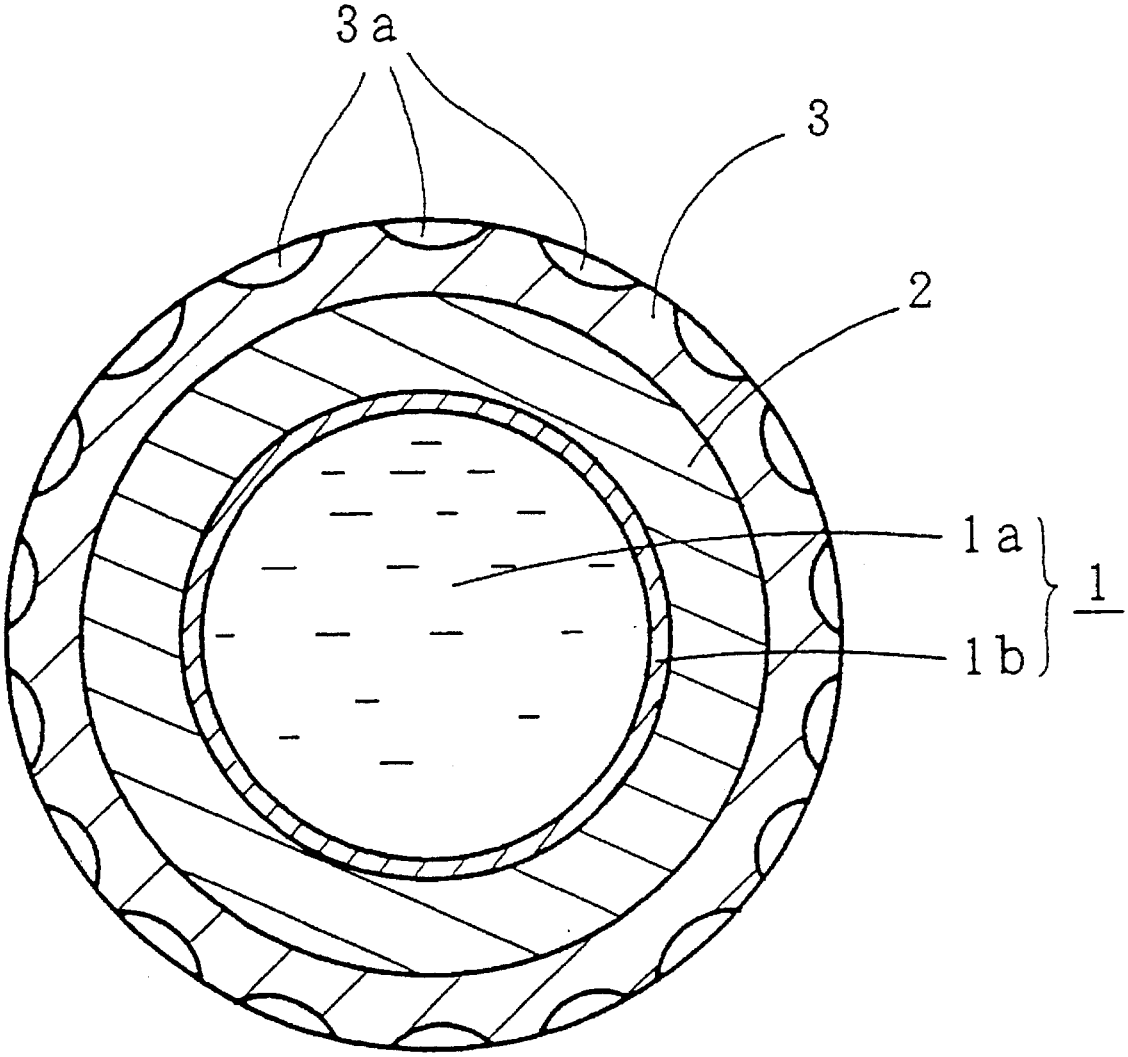

The paste may be prepared by formulating freezing-point depressants such as glycerine, fillers for adjusting specific gravity, viscosity modifiers, etc. in water.

As the filler for adjusting specific gravity, there can be normally used barium sulfate ($BaSO_4$), sodium sulfate ($Na_2SO_4$) and the like, but it is not limited thereto.

As the viscosity modifier, there can be used bentonite clay, natural hectorite and the like, but it is not limited thereto.

In the present invention, the viscosity at 23° C. (measured by a B type viscometer) of the paste to be used is specified within a range of 15 to 70 poise. The reason is as follows.

When the viscosity of the paste (i.e. viscosity at 23° C. measured by a B type viscometer of the paste, which is merely referred to as "viscosity", hereinafter) is smaller than 15 poise, the paste is liable to be separated into water and a filler when standing after preparation, thereby causing deviation of gravity of the center. Therefore, the flying performances are scattered. Further, the paste is pelletized by injecting into a mold in the preparation of the liquid center. In that case, the paste is liable to be escaped from the mold so that it becomes difficult to prepare a spherical pellet.

When the viscosity of the paste is larger than 70 poise, the paste becomes too hard and, therefore, entrapment of air is liable to be arisen. Therefore, scattering of weight is liable to be arisen and, further, fluidity of the paste becomes inferior so that it becomes difficult to prepare a spherical pellet.

Accordingly, it is desired that the viscosity of the paste is set within a narrow range included in the above range. It is particularly preferred that the viscosity is within a range of 25 to 60.

The thread wound golf ball of the present invention is prepared by covering the paste with a center bag to form a liquid center, winding a thread rubber around the liquid center to form a thread rubber layer and then covering the thread rubber layer with a cover.

Hereinafter, a structure of the thread wound golf ball of the present invention will be explained with reference to the accompanying drawing.

FIG. 1 is a schematic cross section illustrating one embodiment of the thread wound golf ball of the present invention. In FIG. 1, 1 is a liquid center which is prepared by covering a paste 1*a* with a center bag 1*b*. 2 is a thread rubber layer which is formed by winding a thread rubber around the liquid center 1.

3 is a cover which is formed by covering a cover on a so-called thread wound core comprising the liquid center 1 and the thread rubber layer 2. Further, a plurality of dimples 3*a*, preferably 350 to 450 dimples, more preferably 420±25 dimples are provided on the cover 3. It is preferred that the total volume of the dimples 3*a* is 280 to 340 $mm^3$, particularly 300 to 335 $mm^3$.

The preparation method of the liquid center 1 will be briefly explained below. Firstly, a paste 1*a* is injected into a mold and frozen to form a spherical pellet, or injected in a half of the mold and frozen and then two halves of the mold are combined each other to form a spherical pellet. A center bag 1*b* is composed of a vulcanized rubber composition and has a sheet-like form before vulcanization. The center bag is covered on the spherical pellet of the paste, which is then vulcanized. As a result, a liquid center 1 as shown in FIG. 1 can be obtained.

When a non-vulcanized sheet of the center bag is covered on the spherical pellet of the paste, for example, the non-vulcanized sheet of a rubber composition is placed on the inner surface of one half of the mold and the spherical pellet of the paste was placed thereon, and then the pellet is covered with the non-vulcanized sheet of the rubber composition.

Thereafter, the other half of the mold is put thereon and the rubber composition is vulcanized to prepare a liquid center 1 of a spherical paste 1*a* and a center bag 1*b*.

Further, there can also be used a method of combining two halves of the pre-vulcanized center bag in a paste solution to prepare a liquid center, and the preparation method of the liquid center is not specifically limited.

The thread rubber layer 2 is formed by winding a thread rubber around the liquid center 1 of which hardness and shape retention are imparted by freezing in the stretched state.

The cover 3 is formed by injection molding of a cover material on the outer surface of a thread wound core of the liquid center 1 and the thread rubber layer 2, or by putting a couple of half-shells (semi-spherical shell), which have been made from the cover material in advance, on the thread wound core to form a spherical cover material which is subjected to compression molding using a mold.

As the center bag, thread rubber and cover, there can be used those which are used for this kind of the application.

The formulations of the center bag, thread wound and cover including the formulation of the paste are as follows, but are not limited thereto.

① Formulation of paste

| Component | Amount (Parts by weight) |
|---|---|
| Water | 88 |
| Glycerine | 12 |
| Bentonite clay | 10 to 30 |
| Barium sulfate | 50 to 150 |

The reason why the amount of barium sulfate is within the above range is that the specific gravity is adjusted according to the diameter such that the ball weight becomes not more than 45.92 g as a specification. It is preferred that the specific gravity of the paste is normally not less than 1.1, particularly 1.3 to 2.0.

The reason why the amount of bentonite clay is within the above range is that the viscosity is adjusted within a desirable range included in the range of 15 to 70 poise.

② Formulation of center bag:

| Component | Amount (Parts by weight) |
|---|---|
| Natural rubber | 100 |
| Filler | 30 ± 10 |
| Sulfur + accelerator | 4 |

Also, regarding the center bag, the weight is adjusted by varying the amount of the filler such that the ball weight becomes not more than 45.92 g as a specification. Preferred example of the filler include calcium carbonate, barium sulfate, zinc oxide and the like.

The production process of the liquid center is not specifically limited, and the liquid center can be produced by the above method which has hitherto been used. The thickness of the center bag is preferably 1.5 to 2.0 mm, and the hardness of the center bag after vulcanization is preferably 40 to 60 (measured by a JIS-A type hardness tester). Regarding the vulcanization conditions of the center (i.e. vulcanization conditions of the rubber composition for center bag), it is preferred that the vulcanization temperature is 145° to 165° C. and the vulcanization time is 10 to 40 minutes. However, the vulcanization conditions are not specifically limited, and the time and temperature may be suitably adjusted such that a desirable hardness can be obtained.

The size of the liquid center is preferably 26 to 32 mm. When the size is smaller than the above range, the amount of spin is increased so that it becomes difficult to attain the large flying distance. On the other hand, when the size is larger than the above range, the amount of the thread rubber to be wound becomes small, which results in insufficient hardness of the golf ball. Particularly preferred size of the liquid center is 28 to 31.5 mm.

③ Thread rubber:

The elastic thread rubber having a thickness of 0.4 to 0.6 mm and a width of 1.3 to 1.8 mm, which is made of natural rubber or isoprene rubber or a blend rubber thereof, was used.

It is preferred to increase the diameter of the liquid center in order to decrease the amount of spin of the golf ball, thereby increasing the flying distance. However, when the diameter of the liquid center is increased, the amount of the thread rubber to be wound becomes small and, therefore, it becomes difficult to obtain the requisite hardness. Therefore, it is preferred to obtain the requisite hardness by using a thread rubber having a large stretch ratio.

As the thread rubber, there can be used preferably a blend of natural rubber and isoprene rubber, wherein the proportion of isoprene rubber is large, particularly a blend wherein the proportion of natural rubber to isoprene rubber is 20:80 to 50:50 in weight. Further, the diameter of the core after winding of the thread rubber is preferably 39.8±0.5 μm.

④ Formulation of cover:

| Component | Amount (Parts by weight) |
|---|---|
| Resin | 90 |
| Natural rubber | 10 |
| Filler | 18 |
| Sulfur + accelerator | 2 |

As the resin, there can be suitably used synthetic transpolyisoprene, gutta-percha, balata, high-styrene resin, 1,2-polybutadiene, transpolybutadiene and the like. Among them, most popular resin is a synthetic transpolyisoprene [TP-301 (trade name), manufactured by Kuraray Co., Ltd.]. Further, the hardness of the cover is preferably 70 to 85 (JIS-C type hardness tester).

As described above, according to the present invention, there is provided a thread wound golf ball having uniform flying performances which causes little % of rejects of the liquid center and inclusion of air into the liquid center, wherein no separation of the paste is arisen, by using a paste having a viscosity of 15 to 70 poise at 23° C. (measured by a B type viscometer) as the paste for liquid center.

EXAMPLES

The following Examples and Comparative Examples further illustrate the present invention in detail but are not to be construed to limit the scope thereof.

Examples 1 to 2 and Comparative Examples 1 to 2

According to the formulation shown in Table 1, a paste was prepared and the paste was injected into a mold and then frozen to prepare a spherical pellet. The pellet was covered with a center bag having a thickness of 1.7 mm to prepare a liquid center having a diameter of 30.0 mm.

The viscosity of the paste prepared, the % of rejects of the liquid center, the amount of air and the separation state of the paste after standing for 48 hours were examined. The results are shown in Table 1. The respective measurement methods of the viscosity, the % of rejects, the amount of air and the separation state of paste are as follows.

Viscosity of paste:

The viscosity at 23° C. of the paste prepared is measured by a B type viscometer. The B type viscometer used is No.1 Rotor of VT-04 manufactured by Rion Co.

% of Rejects of center:

The weight of the liquid center after vulcanization of the center bag is measured and off-specification centers shall be taken as rejects. The measurement of the % of rejects is conducted as to the respective 100 liquid centers of Examples and Comparative Examples.

Amount of air:

Regarding the liquid center after vulcanization of the center bag, the center bag was broken in water at 23° C. and air was collected in a measuring cylinder to measure the amount of air. The amount of air was measured as to the respective 12 liquid centers of Examples and Comparative Examples. The results are shown in the average value thereof.

Separation of paste:

The liquid center after vulcanization of the center bag was allowed to stand for 48 hours, and then the center bag was broken gently to examine whether the paste was separated into water and filler or not.

The separation of the paste was examined as to the respective 12 liquid centers of Examples and Comparative Examples. Regarding the results, the total number of the samples is described in the denominator and the number of the samples wherein separation of the paste was arisen is described in the numerator.

In Table 1, "parts" are by weight unless otherwise stated. The formulation of the center bag is as follows, and the vulcanization was conducted by heating at 154° C. for 16 minutes under pressure.

Formulation of center bag:

| Component | Amount (Parts by weight) |
|---|---|
| Natural rubber | 100 |
| zinc oxide | 5 |
| Calcium carbonate | 25 |
| Sulfur | 2 |
| Accelerator | 2 |

TABLE 1

| | Example No. | | Comparative Example No. | |
|---|---|---|---|---|
| | 1 | 2 | 1 | 2 |
| Water | 88 | 88 | 88 | 88 |
| Glycerine | 12 | 12 | 12 | 12 |
| Bentonite clay | 14 | 17 | 10 | 23 |
| Barium sulfate | 64 | 60 | 69 | 54 |
| Viscosity of paste (poise) | 30 | 50 | 10 | 80 |
| % of rejects of center | 1.5 | 2.3 | 4 | 7 |
| Amount of air (cc) | 0.4 | 0.5 | 0.6 | 1.0 |
| Separation of paste | 0/12 | 0/12 | 8/12 | 0/12 |

As shown in Table 1, since the respective pastes of Examples 1 and 2 have a proper viscosity, the % of rejects of the center was low and the amount of air was small and, further, no separation of the paste was arisen.

To the contrary, since the viscosity of the paste of Comparative Example 1 is too low, separation of the paste was arisen and the % of rejects became high. Further, since the viscosity of the paste of Comparative Example 2 is too high, the % of rejects of the center was high and the amount of air was large.

Then, a thread rubber was wound around the liquid centers of Examples 1 and 2 and that of Comparative Example 1 to form a thread rubber layer, and then a cover was covered on the thread rubber layer to prepare a thread wound golf ball having an average outer diameter of 42.7 mm, respectively. Further, dimples were provided on the outer surface of these thread wound golf balls on cover molding. The number and the total volume of dimples were 400 and 315 $mm^3$, respectively.

The amount of spin, the flying distance and the deviation in right and left directions of the resulting thread wound golf ball were measured. The results are shown in Table 2.

The measurement methods of the amount of spin, the flying distance and the deviation in right and left directions of the resulting thread wound golf ball are as follows.

Thread rubber:

An elastic thread rubber having a thickness of 0.5 mm and a width of 1.5 mm, which is made of a blend rubber of natural rubber and isoprene rubber (blend ratio=30:70) was used.

Formulation of cover:

| Component | Amount (Parts by weight) |
|---|---|
| Synthetic transpolyisoprene | 80 |
| High-styrene resin | 10 |
| Natural rubber | 10 |

-continued

| Formulation of cover: | |
|---|---|
| Component | Amount (Parts by weight) |
| Zinc oxide | 3 |
| Titanium dioxide | 15 |
| Sulfur | 1.5 |
| Accelerator | 0.5 |

Amount of spin:

A golf ball was hit with a metal head club at a head speed of about 45 m/second using a Swing robot manufactured by True Temper Co., and a photograph of the golf ball was taken to determine the amount of spin. The amount of spin was measured as to the respective 8 golf balls of Examples and Comparative Examples. The results are shown by the average value thereof.

Flying distance:

A golf ball was hit with a metal head driver at a head speed of about 45 m/second using a Swing robot manufactured by True Temper Co., and the distance up to the point where the golf ball was dropped, (carry), was measured. The flying distance was measured as to the respective 8 golf balls of Examples and Comparative Examples. The results are shown by the average value thereof.

Deviation in right and left directions:

A golf ball was hit with a metal head driver at a head speed of about 45 m/second using a Swing robot manufactured by True Temper Co., and the distance of deviation from the center line in right and left directions of the golf ball was measured. The deviation in right and left directions was measured as to the respective 8 golf balls of Examples and Comparative Examples. The results are shown by the maximum value and the average value thereof (yard).

TABLE 2

| | Example No. | | Comparative Example No. |
|---|---|---|---|
| | 1 | 2 | 1 |
| Amount of spin (rpm) Average value | 3230 | 3280 | 3220 |
| Flying distance (yard) Average value | 228 | 229 | 225 |
| Deviation in right and left directions (yard) | | | |
| Maximum value | 8 | 7 | 12 |
| Average value | 4 | 5 | 7 |

As is apparent from the results shown in Table 2, the golf balls of Examples 1 and 2 exhibited large flying distance and small deviation in right and left directions in comparison with Comparative Example 1.

The golf ball of Comparative Example 1 exhibited large scattering of the flying distance. As a result, the average value of the flying distance became small and the deviation in right and left directions was large. It is considered that this is because that the viscosity of the paste of Comparative Example 1 is too small and, therefore, those separated from the paste were produced, thereby influencing the flying performances.

To the contrary, regarding the golf balls the Examples 1 and 2, the viscosity of the paste is proper and no separation of the paste is arisen in the liquid center so that scattering of the flying distance is small. As a result, the average value of the flying distance became large and the deviation in right and left directions became small.

What is claimed is:

1. A thread wound golf ball comprising:

a liquid center;

a rubber thread layer wound on said liquid center to form a thread wound core; and a cover covering said thread wound core, wherein said liquid center comprises a paste and a center bag covering the paste and the paste has a viscosity at 23° C. (measured by a B type viscometer) of 15 to 70 poise.

2. The thread wound golf ball according to claim 1 wherein said paste comprises a freezing-point depressant, a filler adjusting specific gravity and a viscosity modifier.

3. The thread wound golf ball according to claim 2 wherein said freezing-point depressant is glycerin.

4. The thread wound golf ball according to claim 2 wherein said filler adjusting specific gravity is selected from the group consisting of barium sulfate, sodium sulfate and a mixture thereof.

5. The thread wound golf ball according to claim 2 wherein said viscosity modifier is selected from group consisting of bentonite clay, natural hectorite and a mixture thereof.

6. The thread wound gold ball according to claim 2 wherein said paste has a viscosity of 23° C. of 25 to 60 poise.

7. The thread wound gold ball according to claim 6 wherein said freezing-point depressant is glycerin; said filler adjusting specific gravity is selected from the group consisting of barium sulphate, sodium sulphate and a mixture thereof; and said viscosity modifier is selected from the group consisting of bentonite clay, natural hectorite and mixture thereof.

8. The thread wound golf ball according to claim 1 wherein said paste has a viscosity at 23° C. of 25 to 60 poise.

* * * * *